US012520868B2

(12) United States Patent
Jung et al.

(10) Patent No.: US 12,520,868 B2
(45) Date of Patent: Jan. 13, 2026

(54) TOBACCO EXTRACT SHEET, METHOD FOR MANUFACTURING THE SAME AND SMOKING ARTICLE INCLUDING THE SAME

(71) Applicant: KT&G CORPORATION, Daejeon (KR)

(72) Inventors: Kyung Bin Jung, Daejeon (KR); Ick Joong Kim, Daejeon (KR); Geon Chang Lee, Daejeon (KR); Eun Mi Jeoung, Daejeon (KR); Min Hee Hwang, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 378 days.

(21) Appl. No.: 18/034,819

(22) PCT Filed: Apr. 21, 2022

(86) PCT No.: PCT/KR2022/005743
§ 371 (c)(1),
(2) Date: May 1, 2023

(87) PCT Pub. No.: WO2022/231212
PCT Pub. Date: Nov. 3, 2022

(65) Prior Publication Data

US 2023/0413892 A1 Dec. 28, 2023

(30) Foreign Application Priority Data

Apr. 29, 2021 (KR) ..... 10-2021-0055426

(51) Int. Cl.
*A24B 15/26* (2006.01)
*A24B 3/14* (2006.01)
(Continued)

(52) U.S. Cl.
CPC ..... *A24B 15/26* (2013.01); *A24B 3/14* (2013.01); *A24B 15/14* (2013.01); *A24D 1/002* (2013.01);
(Continued)

(58) Field of Classification Search
None
See application file for complete search history.

(56) References Cited

U.S. PATENT DOCUMENTS 5,065,775 A 11/1991 Fagg
5,617,881 A 4/1997 Kossmehl et al.
(Continued)

FOREIGN PATENT DOCUMENTS

CN 102349699 A 2/2012
CN 103462205 A 12/2013
(Continued)

OTHER PUBLICATIONS

Translation of CN103462205B, Google Patents, [online], retrieved from the internet, [retrieved Jul. 8, 2025], URL:https://patents.google.com/patent/CN103462205B/en?oq=CN-103462205. (Year: 2025).*
(Continued)

*Primary Examiner* — Dennis R Cordray
(74) *Attorney, Agent, or Firm* — Sughrue Mion, PLLC

(57) ABSTRACT

A tobacco extract sheet, a method of producing the same, and a smoking article including the same are provided. The tobacco extract sheet according to some embodiments of the present disclosure may be produced from a sheet-producing liquid which includes a first tobacco extract solution, a second tobacco extract solution, and a sheet-forming agent, wherein the first tobacco extract solution may include water as an extraction solvent, and the second tobacco extract solution may include a material other than water as an
(Continued)

extraction solvent. The tobacco extract sheet produced in this way may be applied to a smoking article and may significantly improve persistence of a tobacco smoke taste of the smoking article.

8 Claims, 5 Drawing Sheets

(51) Int. Cl.

| | |
|---|---|
| ***A24B 15/14*** | (2006.01) |
| ***A24D 1/00*** | (2020.01) |
| ***A24D 1/02*** | (2006.01) |
| ***A24D 3/10*** | (2006.01) |
| ***A24D 3/14*** | (2006.01) |
| *A24D 3/04* | (2006.01) |

(52) U.S. Cl.
CPC ..... *A24D 1/02* (2013.01); *A24D 3/10* (2013.01); *A24D 3/14* (2013.01); *A24D 3/043* (2013.01)

(56) References Cited

U.S. PATENT DOCUMENTS

| | | | | |
|---|---|---|---|---|
| 2005/0066985 | A1* | 3/2005 | Borschke ..... | A24D 1/00 131/365 |
| 2007/0023058 | A1 | 2/2007 | Howell et al. | |
| 2009/0038629 | A1 | 2/2009 | Ergle et al. | |
| 2012/0138074 | A1 | 6/2012 | Cantrell et al. | |
| 2018/0279666 | A1* | 10/2018 | Aoun ..... | A24B 15/32 |
| 2021/0112847 | A1 | 4/2021 | Ferrie et al. | |
| 2021/0153542 | A1 | 5/2021 | Sintyureva | |

FOREIGN PATENT DOCUMENTS

| | | | |
|---|---|---|---|
| CN | 104997160 | A | 10/2015 |
| CN | 110022698 | A | 7/2019 |
| EP | 3 287 015 | A1 | 2/2018 |
| JP | WO2010/113702 | A1 | 10/2010 |
| JP | 2018-515119 | A | 6/2018 |
| JP | 6389004 | B2 | 9/2018 |
| JP | 2021-35370 | A | 3/2021 |
| KR | 10-2008-0031904 | A | 4/2008 |
| KR | 10-2019-0107193 | A | 9/2019 |
| KR | 10-2019-0132539 | A | 11/2019 |
| WO | 2020/025714 | A1 | 2/2020 |
| WO | 2021/019072 | A2 | 2/2021 |

OTHER PUBLICATIONS

Office Action issued Feb. 22, 2025 in Chinese Patent Application No. 202280007214.4.

Extended European Search Report issued Mar. 11, 2024 in European Application No. 22796045.7.

Office Action issued Apr. 30, 2024 in Japanese Application No. 2023-524526.

International Search Report for PCT/KR2022/005743 dated Aug. 3, 2022.

Written Opinion for PCT/KR2022/005743 dated Aug. 3, 2022.

* cited by examiner

TOBACCO EXTRACT SHEET, METHOD FOR MANUFACTURING THE SAME AND SMOKING ARTICLE INCLUDING THE SAME

CROSS REFERENCE TO RELATED APPLICATIONS

This application is a National Stage of International Application No. PCT/KR2022/005743 filed Apr. 21, 2022, claiming priority based on Korean Patent Application No. 10-2021-0055426 filed Apr. 29, 2021.

TECHNICAL FIELD

The present disclosure relates to a tobacco extract sheet, a method of producing the same, and a smoking article including the same, and more particularly, to a tobacco extract sheet capable of improving persistence of a tobacco smoke taste of a smoking article, an efficient method of producing the tobacco extract sheet, and a smoking article with improved persistence of a tobacco smoke taste due to including the tobacco extract sheet.

BACKGROUND ART

In recent years, demand for alternative smoking articles that overcome the disadvantages of traditional cigarettes has increased. For example, demand for devices that electrically heat a cigarette to generate smoke and/or an aerosol has increased, and accordingly, active research has been carried out on heating-type cigarettes.

In particular, recently, research for enhancing a tobacco smoke taste of a heating-type cigarette (or a tobacco smoke taste) has been especially actively carried out. Also, as part of this research, a method in which a liquid tobacco extract, a flavoring liquid, or the like is directly added to a smoking material, such as shredded tobacco, or a filter plug has been proposed. However, although a tobacco smoke taste may be improved in early puffs with the proposed method, an insufficient tobacco smoke taste in mid and late puffs cannot be compensated for due to tobacco smoke taste components in the added liquid being rapidly transferred.

DISCLOSURE

Technical Problem

Some embodiments of the present disclosure are directed to providing a tobacco extract sheet capable of improving persistence of a tobacco smoke taste of a smoking article Some embodiments of the present disclosure are also directed to providing an efficient method of producing a tobacco extract sheet.

Some embodiments of the present disclosure are also directed to providing a smoking article with improved persistence of a tobacco smoke taste.

Objectives of the present disclosure are not limited to the above-mentioned objectives, and other unmentioned objectives should be clearly understood by those of ordinary skill in the art to which the present disclosure pertains from the description below.

Technical Solution

Some embodiments of the present disclosure provide a tobacco extract sheet that is produced from a sheet-producing liquid which includes a first tobacco extract solution, a second tobacco extract solution, and a sheet-forming agent, wherein the first tobacco extract solution may include water as an extraction solvent, and the second tobacco extract solution may include a material other than water as an extraction solvent.

In some embodiments, the sheet-forming agent may be a cellulose-based material.

In some embodiments, the extraction solvent of the second tobacco extract solution may be ethyl alcohol.

In some embodiments, the extraction solvent of the second tobacco extract solution may be a plasticizer.

In some embodiments, the extraction solvent of the second tobacco extract solution may be ethyl alcohol, the sheet-producing liquid may further include a third tobacco extract solution, and the third tobacco extract solution may include a plasticizer as an extraction solvent.

In some embodiments, the sheet-producing liquid may further include a bulking agent.

Some embodiments of the present disclosure provide a smoking article including a smoking material portion, a filter portion, and a wrapper wrapped around at least a portion of the smoking material portion, wherein a tobacco extract sheet may be applied to at least one of the smoking material portion, the filter portion, and the wrapper, and the tobacco extract sheet may be produced from a sheet-producing liquid which includes one or more tobacco extract solutions and a sheet-forming agent.

Advantageous Effects

According to some embodiments of the present disclosure, a tobacco extract sheet can be provided from a sheet-producing liquid which includes one or more tobacco extract solutions and a sheet-forming agent. Unlike a liquid tobacco extract, the tobacco extract sheet can slowly release tobacco smoke taste (tobacco smoke flavor) components and thus can compensate for an insufficient tobacco taste and tobacco smoke taste in mid and late puffs, and accordingly, persistence of a tobacco smoke taste of a smoking article can be improved.

Also, materials (e.g., water, ethyl alcohol, a plasticizer) used in preparing the sheet-producing liquid can be used as extraction solvents that constitute the tobacco extract solutions. Accordingly, the sheet-producing liquid can be immediately prepared when the tobacco extract solutions and the sheet-forming agent are mixed, and thus efficiency of the sheet producing process can be significantly improved.

In addition, a plurality of tobacco extract solutions prepared with different extraction solvents may constitute the sheet-producing liquid. In this case, different tobacco smoke taste components can be extracted from a tobacco material due to the different extraction solvents, and thus a tobacco taste and a tobacco smoke taste of a smoking article can be further enhanced.

The advantageous effects according to the technical spirit of the present disclosure are not limited to those mentioned above, and other unmentioned advantageous effects should be clearly understood by those of ordinary skill in the art from the description below.

MODES OF THE INVENTION

Figure 1:
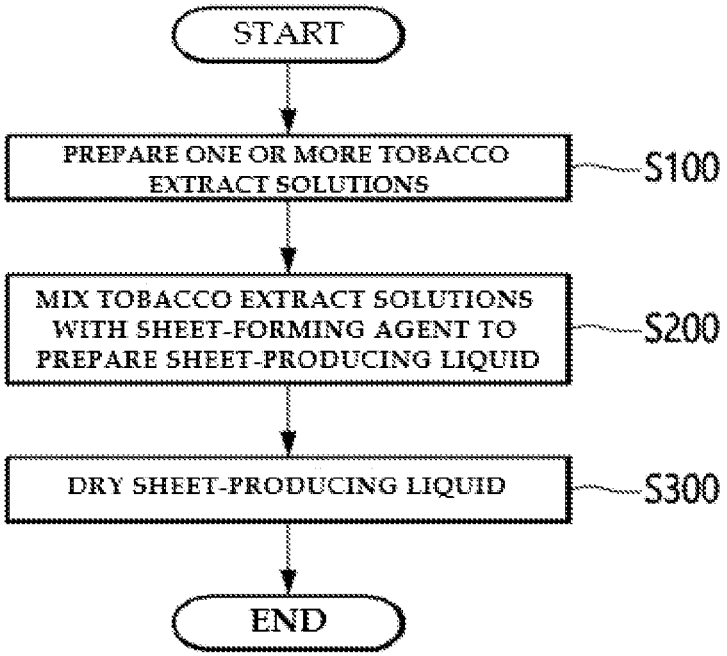
FIG. 1 is an exemplary flowchart schematically illustrating a method of producing a tobacco extract sheet according to some embodiments of the present disclosure.

Hereinafter, exemplary embodiments of the present disclosure will be described in detail with reference to the accompanying drawings. Advantages and features of the present disclosure and methods of achieving the same should become clear from embodiments described in detail below with reference to the accompanying drawings. However, the technical spirit of the present disclosure is not limited to the following embodiments and may be implemented in various different forms. The following embodiments only make the technical spirit of the present disclosure complete and are provided to completely inform those of ordinary skill in the art to which the present disclosure pertains of the scope of the disclosure. The technical spirit of the present disclosure is defined only by the scope of the claims.

In assigning reference numerals to components of each drawing, it should be noted that the same reference numerals are assigned to the same components where possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used in this specification have the same meaning as commonly understood by those of ordinary skill in the art to which the present disclosure pertains. Terms defined in commonly used dictionaries should not be construed in an idealized or overly formal sense unless expressly so defined herein. Terms used in this specification are for describing the embodiments and are not intended to limit the present disclosure. In this specification, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the possibility of presence or addition of one or more components, steps, operations, and/or devices other than those mentioned.

First, some terms used in various embodiments of the present disclosure will be clarified.

In the following embodiments, "smoking article" may refer to any product that can be smoked or any product that can provide a smoking experience, regardless of whether the product is based on tobacco, tobacco derivatives, expanded tobacco, reconstituted tobacco, or tobacco substitutes. For example, smoking articles may include products that can be smoked, such as a cigarette, a cigar, and a cigarillo. As another example, smoking articles may include a combustion-type smoking article and a heating-type smoking article.

In the following embodiments, "smoking material" may refer to any material that generates smoke and/or an aerosol or is used in smoking. For example, the smoking material may include a tobacco material. For example, the tobacco material may include pieces of tobacco leaves, tobacco stems, or materials obtained by processing the pieces of tobacco leaves or tobacco stems. As a more specific example, the tobacco material may include ground tobacco leaves, ground reconstituted tobacco, expanded shredded tobacco, expanded tobacco midribs, and reconstituted tobacco leaves but is not limited thereto.

In the following embodiments, "upstream" or "upstream direction" may refer to a direction moving away from an oral region of a smoker, and "downstream" or "downstream direction" may refer to a direction approaching the oral region of the smoker. The terms "upstream" and "downstream" may be used to describe relative positions of elements constituting a smoking article. For example, in a smoking article 100 illustrated in FIG. 2, a filter portion 120 is disposed downstream of or in a downstream direction from a smoking material portion 110, and the smoking material portion 110 is disposed upstream of or in an upstream direction from the filter portion 120.

In the following embodiments, "longitudinal direction" may refer to a direction corresponding to a longitudinal axis of a smoking article.

In the following embodiments, "puff" refers to inhalation by a user, and the inhalation may be a situation in which a user draws smoke into his or her oral cavity, nasal cavity, or lungs through the mouth or nose.

Hereinafter, various embodiments of the present disclosure will be described in detail with reference to the accompanying drawings.

According to some embodiments of the present disclosure, a tobacco extract sheet capable of improving persistence of a tobacco smoke taste of a smoking article can be provided. The tobacco extract sheet may be produced from a sheet-producing liquid which includes one or more tobacco extract solutions and a sheet-forming agent and may be applied to a smoking article in various ways to improve persistence of a tobacco smoke taste of the smoking article. Specifically, by slowly releasing tobacco smoke taste components contained therein during smoking, the tobacco extract sheet can compensate for an insufficient tobacco taste and tobacco smoke taste in mid and late puffs. Accordingly, persistence of a tobacco smoke taste of a smoking article can be guaranteed, and a smoker's smoking satisfaction can be improved. Hereinafter, the tobacco extract sheet and a method of producing the same will be described in detail with reference to FIG. 1.

FIG. 1 is an exemplary flowchart schematically illustrating a method of producing a tobacco extract sheet according to some embodiments of the present disclosure. However, this is only an exemplary embodiment for achieving the objectives of the present disclosure, and, of course, some steps may be added or omitted as necessary.

As illustrated in FIG. 1, the producing method according to the present embodiment may begin by preparing one or more tobacco extract solutions (S100). For example, under predetermined conditions, a tobacco material (e.g., tobacco leaves) may be immersed in an extraction solvent, and impurities may be removed therefrom using a filter or the like to prepare a tobacco extract solution. Also, the tobacco extract solution prepared in this way may include a tobacco smoke taste component (a solute), which is extracted from a tobacco material, and an extraction solvent.

The extraction solvent may include at least one of water, ethyl alcohol (e.g., ethanol), and a plasticizer, and one or more tobacco extract solutions may be prepared using the extraction solvents. For example, a first tobacco extract solution may be prepared by using water as an extraction solvent, and a second tobacco extract solution may be prepared by using ethyl alcohol as an extraction solvent. Also, a third tobacco extract solution may be prepared by using a plasticizer as an extraction solvent. Here, for example, the plasticizer may be propylene glycol (PG) or glycerin (GLY), but the plasticizer is not limited thereto.

It may be understood that the reason for using water, ethyl alcohol, or a plasticizer as an extraction solvent is to improve efficiency of the sheet producing process. Specifically, water, ethyl alcohol, a plasticizer, and the like are materials originally used in preparing the sheet-producing liquid. Thus, by mixing the tobacco extract solutions including such materials as solvents with a sheet-forming agent, the sheet-producing liquid can be immediately prepared. Therefore, the efficiency of the sheet producing process can be improved.

For reference, water may be used to melt a sheet-forming agent in the form of powder, and ethyl alcohol may be used to disperse the sheet-forming agent before melting the sheet-forming agent in water. This is because when the sheet-forming agent is dispersed by ethyl alcohol, the sheet-forming agent can more easily melt in water. Also, a plasticizer may be used to impart flexibility to the sheet to improve physical properties of the sheet.

Meanwhile, in step S100, extraction conditions, an amount of added tobacco material, and the like may be set in various ways.

In some embodiments, a tobacco material may be immersed in an extraction solvent for about 24 hours under a temperature condition of around 50° C. Under such conditions, a tobacco smoke taste component can be sufficiently extracted from the tobacco material.

Also, in some embodiments, the amount of added tobacco material may be in a range of about 10 wt % to 50 wt % of the total weight of the tobacco extract solution. Within such numerical ranges, a tobacco smoke taste component can be sufficiently extracted from the tobacco material.

In step S200, the one or more tobacco extract solutions may be mixed with a sheet-forming agent to prepare a sheet-producing liquid. For example, a sheet-forming agent in the form of powder may be mixed with a tobacco extract solution including ethyl alcohol and dispersed, and then a tobacco extract solution including water may be further mixed therewith to prepare a sheet-producing liquid. Also, in some cases, a tobacco extract solution including a plasticizer may be further mixed to prepare a sheet-producing liquid.

The sheet-forming agent may refer to a base material for forming a solid sheet. An example of the sheet-forming agent may be cellulose-based materials, but the sheet-forming agent is not limited thereto. The cellulose-based materials can not only form a sheet with appropriate physical properties but also ensure an excellent holding amount and retention of a tobacco smoke taste by fixing and covering a large amount of tobacco smoke taste components well. Further, the cellulose-based materials have a property of easily absorbing thermal energy due to undergoing a phase change (being crystallized) upon contact with a high-temperature airflow and thus have an advantage that an effect of cooling an airflow in a smoking article can also be enhanced. In addition, since the cellulose-based materials are hydrocolloid materials and have a property of becoming sticky when in contact with a liquid, the cellulose-based materials also have advantages that attachment to a wrapper of a smoking article is possible without an adhesive. As a result, the cellulose-based materials may be free from a safety problem caused by an adhesive.

Examples of the cellulose-based materials include agar, hydroxypropyl methylcellulose (HPMC), methyl cellulose (MC), ethyl cellulose (EC), and carboxymethyl cellulose (CMC), but the cellulose-based materials are not limited thereto.

Meanwhile, components and composition of the sheet-producing liquid may be designed in various ways and may vary according to embodiments.

In a first embodiment, a sheet-producing liquid may include a sheet-forming agent, a first tobacco extract solution, and a second tobacco extract solution. Here, a solvent of the first tobacco extract solution may be water, and a solvent of the second tobacco extract solution may be ethyl alcohol.

Also, the sheet-producing liquid according to the first embodiment may include, with respect to a total of 100 parts by weight, about 5 to 20 parts by weight of the sheet-forming agent, about 40 to 80 parts by weight of the first tobacco extract solution (solvent: water), and about 10 to 50 parts by weight of the second tobacco extract solution (solvent: ethyl alcohol). It was confirmed that, within such numerical ranges, the sheet-forming agent easily melts in a solvent and the sheet-producing liquid can be appropriately prepared, appropriate physical properties of the tobacco extract sheet can be ensured, and the amount of tobacco smoke taste component held in the tobacco extract sheet is also excellent. In addition, it was confirmed through sensory evaluation that a tobacco taste and a tobacco smoke taste of a smoking article are further enhanced due to various tobacco smoke taste components being extracted due to using different extraction solvents.

In a second embodiment, a sheet-producing liquid may include a sheet-forming agent, a first tobacco extract solution, and a second tobacco extract solution. Here, a solvent of the first tobacco extract solution may be water, and a solvent of the second tobacco extract solution may be a plasticizer.

Also, the sheet-producing liquid according to the second embodiment may include, with respect to a total of 100 parts by weight, about 5 to 25 parts by weight of the sheet-forming agent, about 50 to 80 parts by weight of the first tobacco extract solution (solvent: water), and about 5 to 10 parts by weight of the second tobacco extract solution (solvent: ethyl plasticizer). It was confirmed that, within such numerical ranges, physical properties of the tobacco extract sheet and the amount of tobacco smoke taste component held in the tobacco extract sheet are excellent. In addition, it was confirmed through sensory evaluation that a tobacco taste and a tobacco smoke taste of a smoking article are further enhanced due to various tobacco smoke taste components being extracted due to using different extraction solvents.

In a third embodiment, a sheet-producing liquid may include a sheet-forming agent, a first tobacco extract solution, a second tobacco extract solution, and a third tobacco extract solution. Here, a solvent of the first tobacco extract solution may be water, a solvent of the second tobacco extract solution may be ethyl alcohol, and a solvent of the third tobacco extract solution may be a plasticizer.

Also, the sheet-producing liquid according to the third embodiment may include, with respect to a total of 100 parts by weight, about 5 to 20 parts by weight of the sheet-forming agent, about 40 to 80 parts by weight of the first tobacco extract solution (solvent: water), about 10 to 50 parts by weight of the second tobacco extract solution (solvent: ethyl alcohol), and about 5 to 10 parts by weight of the third tobacco extract solution (solvent: plasticizer). It was confirmed that, within such numerical ranges, the sheet-forming agent easily melts in a solvent and the sheet-producing liquid can be appropriately prepared, and physical properties of the tobacco extract sheet and the amount of tobacco smoke taste component held in the tobacco extract sheet are excellent. In addition, it was confirmed through sensory evaluation that a tobacco taste and a tobacco smoke taste of a smoking article are further enhanced due to various tobacco smoke taste components being extracted due to using different extraction solvents.

In some embodiments, the sheet-producing liquid may further include a bulking agent. For example, a bulking agent may be further included as a component of the sheet-producing liquid according to the third embodiment. In this case, the sheet-producing liquid may include, with respect to a total of 100 parts by weight, about 5 to 15 parts by weight of the sheet-forming agent, about 40 to 80 parts by weight of the first tobacco extract solution (solvent: water), about 10 to 50 parts by weight of the second tobacco extract solution (solvent: ethyl alcohol), about 5 to 10 parts by weight of the third tobacco extract solution (solvent: plasticizer), and about 1 to 10 parts by weight of the bulking agent.

The bulking agent may be a material that increases the total mass of components other than water (that is, dry mass) to increase the volume of the tobacco extract sheet being produced but does not affect the original function of the tobacco extract sheet. Specifically, the bulking agent may have characteristics of increasing the volume of the tobacco extract sheet but not adversely affecting the function of retaining (fixing) a tobacco smoke taste component of the tobacco extract sheet while not substantially increasing the viscosity of the slurry (that is, the sheet-producing liquid). The bulking agent may be starch, modified starch, or starch hydrolyzate but is not limited thereto.

Modified starch refers to starch acetate, oxidized starch, hydroxypropyl distarch phosphate, hydroxypropyl starch, distarch phosphate, monostarch phosphate, phosphorylated distarch phosphate, or the like.

Starch hydrolyzate refers to a material obtained by a process that includes a process of hydrolyzing starch. For example, starch hydrolyzate may include a material obtained by directly hydrolyzing starch (that is, dextrin) or a material obtained by heating and hydrolyzing starch (that is, indigestible dextrin). For example, the bulking agent may be dextrin, more specifically, cyclodextrin.

Generally, starch hydrolyzate may be starch hydrolyzate having a dextrose equivalent (DE) value in a range of about 2 to about 40, preferably, starch hydrolyzate having a DE value in a range of about 2 to about 20. For example, as the starch hydrolyzate having a DE value in a range of about 2 to about 20, Pinedex #100 (Matsutani Chemical Industry Co. Ltd), Pinefiber (Matsutani Chemical Industry Co. Ltd), or TK-16 (Matsutani Chemical Industry Co. Ltd) may be utilized.

Here, "DE" is an abbreviation of "dextrose equivalent," and the DE value indicates a degree of hydrolysis of starch, that is, a saccharification rate of starch. In the present disclosure, the DE value may be a value measured by the Willstatter-Schudel method. Characteristics of hydrolyzed starch (starch hydrolyzate), for example, characteristics such as a molecular weight of starch hydrolyzate and an arrangement of sugar molecules constituting starch hydrolyzate, may not be constant for each molecule of starch hydrolyzate and may be present with a certain distribution or variation. Due to the distribution or variation of the characteristics of starch hydrolyzate or a difference in cut sections, each molecule of starch hydrolyzate may exhibit different physical properties (e.g., DE value). In this way, starch hydrolyzate is a set of molecules exhibiting different physical properties, but a measurement result (that is, DE value) by the Willstatter-Schudel method is considered a representative value indicating the degree of hydrolysis of starch.

Starch hydrolyzate may be selected from the group consisting of dextrin having a DE value in a range of about 2 to about 5, indigestible dextrin having a DE value in a range of about 10 to about 15, and a mixture thereof. For example, as the dextrin having a DE value in a range of about 2 to about 5, Pinedex #100 (Matsutani Chemical Industry Co. Ltd) may be utilized. For example, as the indigestible dextrin having a DE value in a range of about 10 to about 15, Pinefiber (Matsutani Chemical Industry Co. Ltd) may be utilized.

Also, in some embodiments, the sheet-forming agent may be modified cellulose or include modified cellulose. Here, "modified cellulose" may refer to cellulose in which a specific functional group is substituted in a molecular structure. Examples of modified cellulose may include HPMC, MC, CMC, and EC, but modified cellulose is not limited thereto. For example, HPMC may have a grade in a range of about 4 to 40000 according to a proportion and molecular weight in which a hydroxypropyl group and a methyl group (or methoxy group) are substituted. The viscosity of modified cellulose may be determined according to the grade. More specifically, physicochemical characteristics of HPMC relate to a proportion of the methoxy group and a proportion and molecular weight of the hydroxypropyl group, and according to the United States Pharmacopeial Convention (USP), types of HPMC may be classified into HPMC1828, HPMC2208, HPMC2906, HPMC2910, and the like according to proportions of the methoxy group and hydroxypropyl group. Here, the first two numbers may refer to a proportion of the methoxy group, and the last two numbers may refer to a proportion of the hydroxypropyl group. As a result of continuous experiments by the inventors of the present disclosure, the tobacco extract sheet produced from a sheet-producing liquid including modified cellulose was confirmed as having excellent physical properties and holding a large amount of tobacco smoke taste component.

Also, in some embodiments, the sheet-producing liquid may further include low methoxyl pectin (LM-pectin). LM-pectin is a low ester pectin or low methoxyl pectin in which relatively little esterification is performed. Specifically, LM-pectin may be pectin that contains a carboxyl group by less than about 50% in a molecular structure. Due to having a characteristic of not gelating when cooled unlike carrageenan, LM-pectin may lower the viscosity of the sheet-producing liquid (e.g., to about 600 cp to 800 cp). Also, it was confirmed through an experiment that the amount of tobacco smoke taste component held in the tobacco extract sheet increases when LM-pectin is added.

LM-pectin may contain a carboxyl group by less than about 50%, less than about 40%, less than about 30%, less than about 20%, or less than about 10% in a molecular structure. The lower the content of carboxyl group in the molecular structure of LM-pectin, the lower the viscosity of a slurry including LM-pectin.

In step S300, the sheet-producing liquid may be dried under predetermined conditions, and as a result, the tobacco extract sheet may be formed. For example, the sheet-producing liquid may be dried under a temperature condition in a range of about 50° C. to 90° C. However, the conditions are not limited thereto.

The tobacco extract sheet and the method of producing the same according to some embodiments of the present disclosure have been described above with reference to FIG. 1. According to the above description, the tobacco extract sheet may be provided from the sheet-producing liquid which includes one or more tobacco extract solutions and a sheet-forming agent. Unlike a liquid tobacco extract, the tobacco extract sheet slowly releases tobacco smoke taste (tobacco smoke flavor) components and thus can compensate for an insufficient tobacco taste and tobacco smoke taste in mid and late puffs, and accordingly, persistence of a tobacco smoke taste of a smoking article can be improved. Also, materials (e.g., water, ethyl alcohol, a plasticizer) originally used in preparing the sheet-producing liquid may be used as extraction solvents that constitute the tobacco extract solutions. Therefore, the sheet-producing liquid can be immediately prepared when the tobacco extract solutions and the sheet-forming agent are mixed, and thus efficiency of the sheet producing process can be significantly improved. In addition, a plurality of tobacco extract solutions prepared with different extraction solvents may constitute the sheet-producing liquid. In this case, different tobacco smoke taste components can be extracted from a tobacco material due to the different extraction solvents, and thus a tobacco taste and a tobacco smoke taste of a smoking article can be further enhanced.

Hereinafter, various embodiments relating to the smoking article with improved persistence of a tobacco smoke taste due to including the tobacco extract sheet will be described with reference to FIG. 2 and so on.

Figure 2:
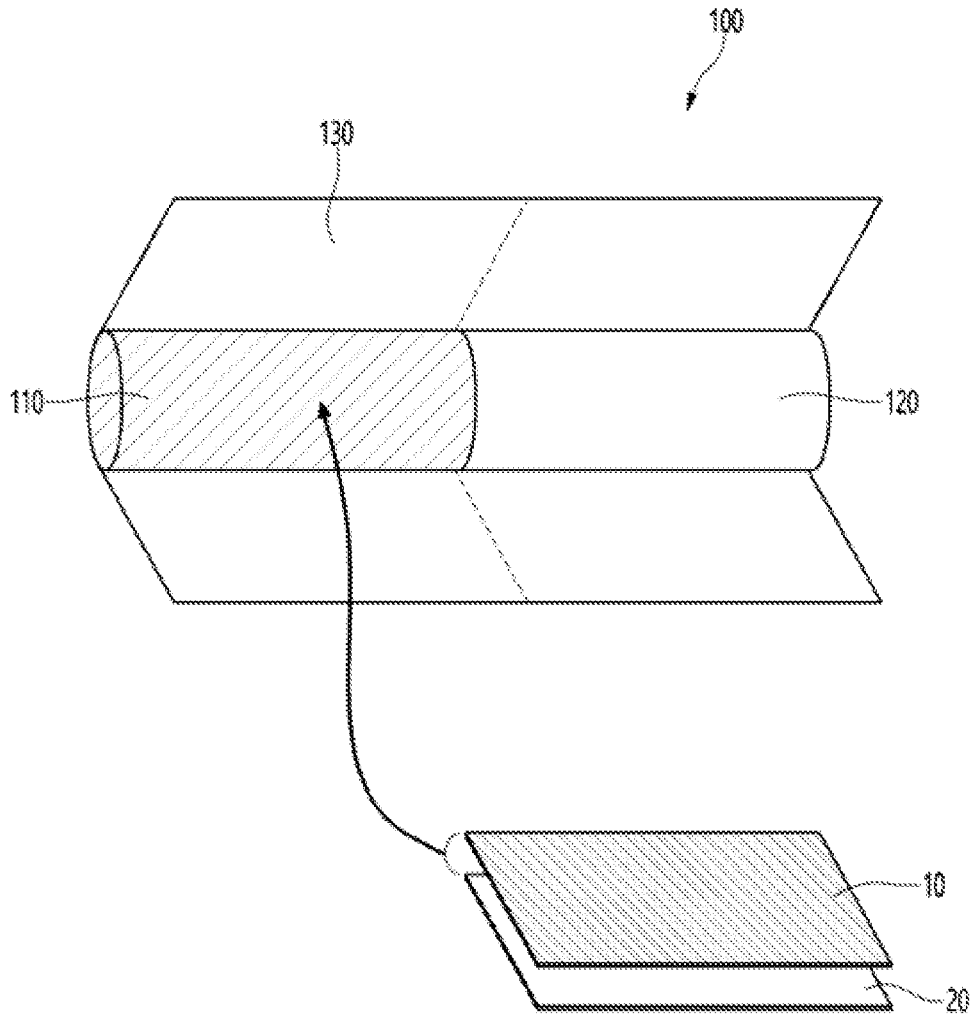
FIGS. 2 and 3 are exemplary views for describing a smoking article with improved persistence of a tobacco smoke taste and methods of applying a tobacco extract sheet thereto according to some embodiments of the present disclosure.

FIG. 2 is an exemplary view schematically illustrating the smoking article 100 with improved persistence of a tobacco smoke taste according to some embodiments of the present disclosure.

Figure 6:
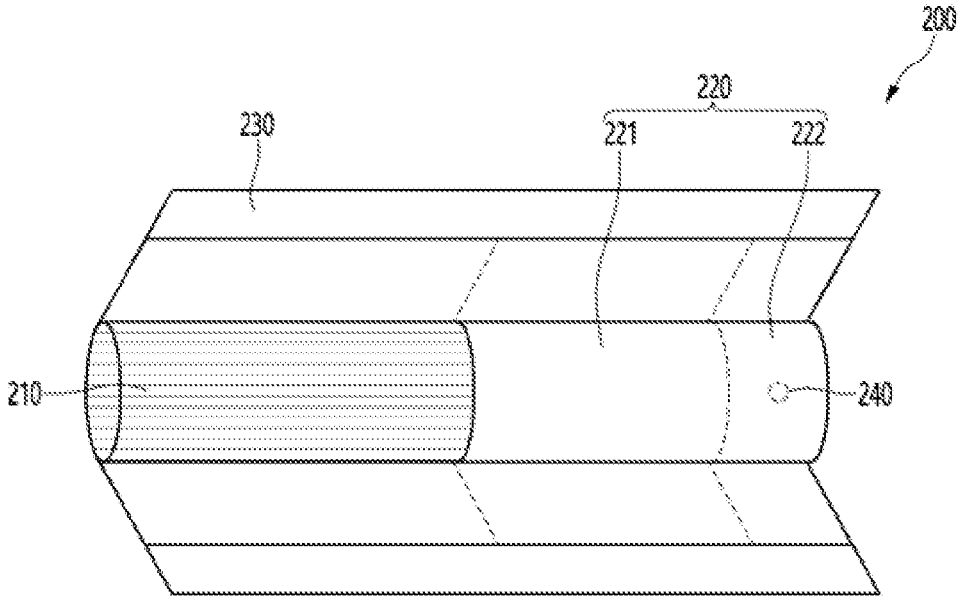
FIG. 6 is an exemplary view schematically illustrating a smoking article with improved persistence of a tobacco smoke taste according to some other embodiments of the present disclosure.
Figure 7:
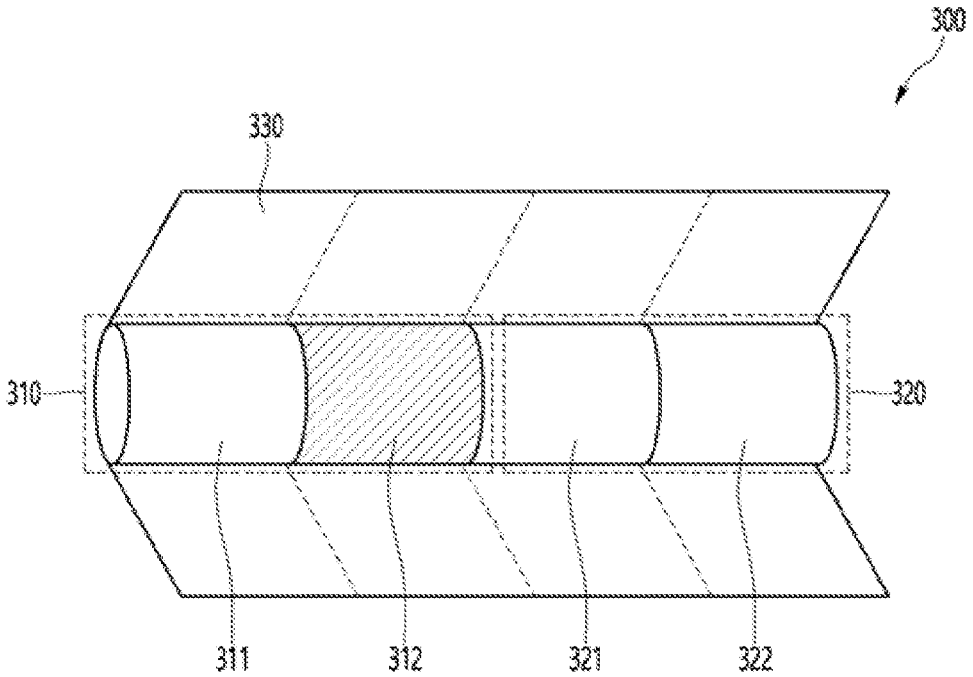
FIG. 7 is an exemplary view schematically illustrating a smoking article with improved persistence of a tobacco smoke taste according to still some other embodiments of the present disclosure.

As illustrated in FIG. 2, the smoking article 100 may include the filter portion 120, the smoking material portion 110, and a wrapper 130. However, only the components relating to the embodiment of the present disclosure are illustrated in FIG. 2. Therefore, those of ordinary skill in the art to which the present disclosure pertains should understand that the smoking article 100 may further include general-purpose components other than the components illustrated in FIG. 2. Also, FIG. 2 only illustrates some examples of smoking articles according to various embodiments of the present disclosure, and a specific structure of the smoking article may be changed from that illustrated in FIG. 2. FIGS. 6 and 7 may be further referenced for other examples of the specific structure of the smoking article. Hereinafter, each component of the smoking article 100 will be described.

The filter portion 120 may perform a function of filtering smoke and/or an aerosol generated from the smoking material portion 110. To this end, the filter portion 120 may include a filter material. Examples of the filter material may include a cellulose acetate fiber, paper, etc., but the scope of the present disclosure is not limited thereto. The filter portion 120 may further include the wrapper 130 that wraps around the filter material (plug).

The filter portion 120 may be disposed downstream of the smoking material portion 110 and connected to a downstream end of the smoking material portion 110. For example, the filter portion 120 and the smoking material portion 110 may have a cylindrical shape (a rod shape), may be aligned in the longitudinal axis direction, and may be connected by a tipping wrapper. The tipping wrapper may wrap around at least a portion of the filter portion 120 and at least a portion of the smoking material portion 110 together to connect the filter portion 120 and the smoking material portion 110. In a case in which the filter portion 120 forms a downstream end of the smoking article 100, the filter portion 120 may also serve as a mouthpiece that comes into contact with the oral region of the smoker.

Since the filter portion 120 is produced in the form of a rod, the filter portion 120 may be referred to as "filter rod 120" in some cases and may be produced in various shapes such as a cylindrical shape, a tubular shape including a hollow therein, and a recessed shape.

Next, the smoking material portion 110 may include a smoking material that can generate smoke and/or an aerosol when combusted or heated. The smoking material portion 110 may further include the wrapper 130 that wraps around the smoking material.

The smoking material portion 110 may be disposed upstream of the filter portion 120 and connected to an upstream end of the filter portion 120. The smoke and/or aerosol generated from the smoking material portion 110 may be inhaled into the oral region of the smoker through the filter portion 120.

Since the smoking material portion 110 is also produced in the form of a rod, the smoking material portion 110 may be referred to as "smoking material rod 110" in some cases.

For example, the smoking material may include a tobacco material. For example, the tobacco material may include pieces of tobacco leaves, tobacco stems, or materials obtained by processing the pieces of tobacco leaves or tobacco stems. As a more specific example, the tobacco material may include ground tobacco leaves, ground reconstituted tobacco, expanded shredded tobacco, expanded tobacco midribs, and reconstituted tobacco leaves but is not limited thereto. Also, the tobacco material may have the form of shredded tobacco, tobacco particles, tobacco sheets, tobacco beads, tobacco granules, or tobacco extracts, but the tobacco material is not limited thereto.

In some embodiments, the smoking material may further include an additive such as a wetting agent (a moisturizer), a flavoring agent, and/or an organic acid. For example, the wetting agent may include at least one of glycerin, propylene glycol, ethylene glycol, dipropylene glycol, diethylene glycol, triethylene glycol, tetraethylene glycol, and oleyl alcohol. The wetting agent may maintain moisture in the tobacco material at an optimum level and thus soften the inherent flavor and produce a large amount of vapor. Also, for example, the flavoring agent may include licorice, saccharose, fructose syrup, isosweet, cocoa, lavender, cinnamon, cardamom, celery, fenugreek, cascarilla, white sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, cilantro, a clove extract (or a clove material), coffee, or the like.

Next, the wrapper 130 may refer to a wrapper that wraps around at least a portion of the smoking material portion 110 and/or the filter portion 120. The wrapper 130 may refer to a separate wrapper of the smoking material portion 110 or the filter portion 120 or may refer to a wrapper, such as a tipping wrapper, that wraps around at least a portion of the smoking material portion 110 and at least a portion of the filter portion 120 together. The wrapper 130 may also collectively refer to all wrappers used in the smoking article 100. The wrapper 130 may be made of porous or nonporous wrapping paper, but the scope of the present disclosure is not limited thereto. For example, the wrapper 130 may be made of a metal foil or have a form in which wrapping paper and a metal foil are laminated with each other.

According to some embodiments of the present disclosure, a tobacco extract sheet 10 may be applied (added) to the smoking material portion 110. For example, cut pieces of the tobacco extract sheet 10 may be added to the smoking material portion 110. In this case, since the tobacco extract sheet 10 can be evenly distributed throughout the entire smoking material portion 110, a tobacco smoke taste intensity of the smoking article 100 can be uniformly maintained during smoking. As another example, as illustrated, the tobacco extract sheet 10 may be added to the smoking material portion 110 together with a tobacco sheet 20. As a specific example, the tobacco extract sheet 10 may be added to the smoking material portion 110 while it is attached to the tobacco sheet 20. The tobacco sheet 20 is a tobacco material in the form of a sheet and may be reconstituted tobacco such as reconstituted tobacco leaves but is not limited thereto.

Figure 3:
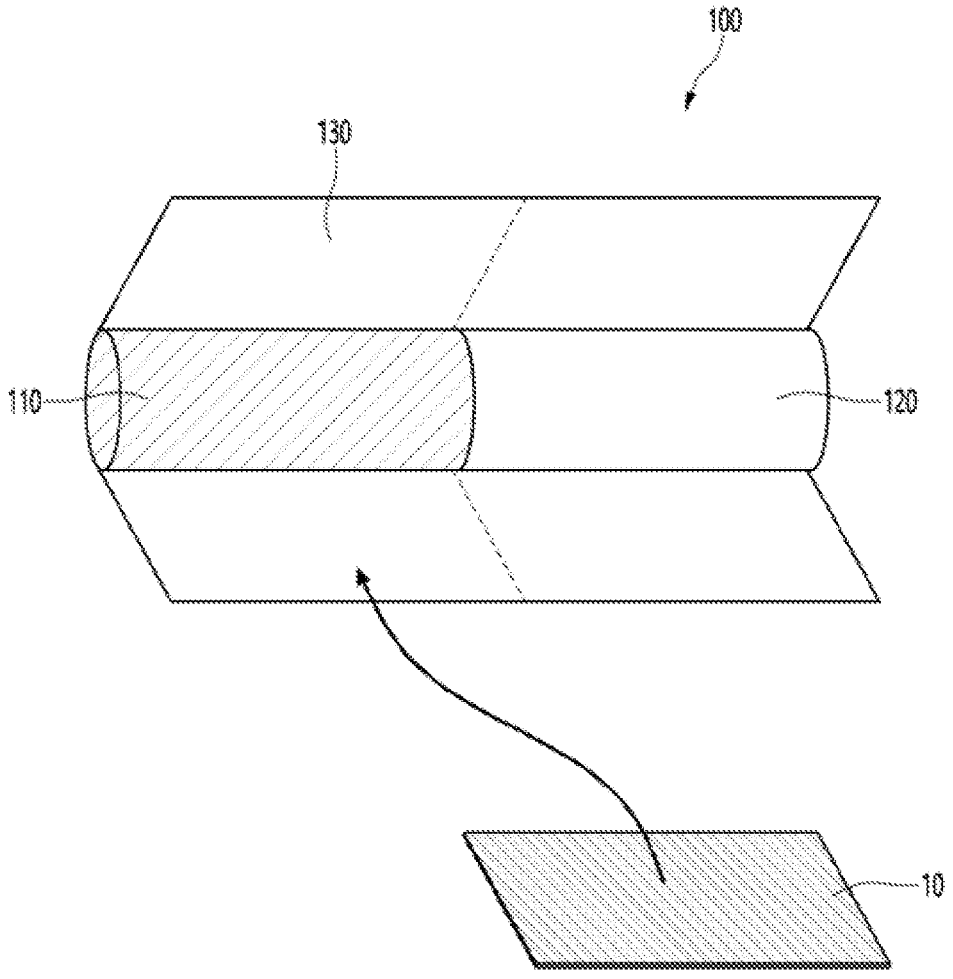

In some other embodiments, as illustrated in FIG. 3, the tobacco extract sheet 10 may be applied to the wrapper 130 of the smoking material portion 110 or the filter portion 120. However, a specific application method may vary.

As one example, the tobacco extract sheet 10 may be disposed (e.g., attached or coated) on an inner side of the wrapper 130. For instance, the tobacco extract sheet 10 may be attached on an inner side of the wrapper 130 of the smoking material portion 110. In this case, transfer of a tobacco smoke taste component included in the tobacco extract sheet 10 may be promoted by heat heating the smoking material portion 110. Also, in a case in which at least a portion of the wrapper 130 is made of a metal foil, the tobacco extract sheet 10 may be disposed on an inner side of the metal foil. In this case, transfer of a tobacco smoke taste component included in the tobacco extract sheet 10 may be further promoted by heat transferred through the metal foil. A process of placing (e.g., attaching or coating) the tobacco extract sheet 10 on the wrapper 130 will be described below with reference to FIGS. 4 and 5.

As another example, the tobacco extract sheet 10 may constitute at least a portion of the wrapper 130. That is, the tobacco extract sheet 10 may serve as the wrapper 130 of the smoking article 100. Here, at least a portion of the wrapper 130 may be made of the tobacco extract sheet 10 only or may be made of a form in which the tobacco extract sheet 10 and the wrapping paper are integrated. In this case, since there is no need to perform a process of placing (e.g., laminating or coating) the tobacco extract sheet 10 on the wrapper 130, a process of manufacturing the smoking article 100 can be further simplified.

Hereinafter, the process of placing the tobacco extract sheet 10 will be further described with reference to FIGS. 4 and 5.

In some embodiments, a wrapping material may be produced through a process of laminating the tobacco extract sheet 10 and the wrapping paper with each other. In order to further provide convenience of understanding, additional description of the present embodiment will be given with reference to FIG. 4.

Figure 4:
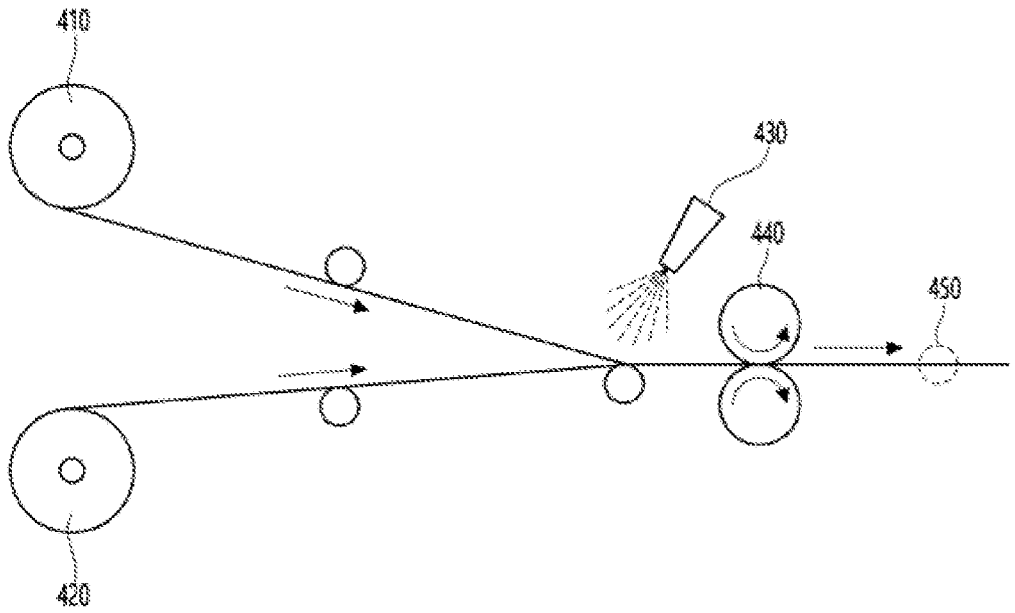
FIG. 4 is an exemplary view for describing a method of producing a wrapping material according to some embodiments of the present disclosure.

As illustrated in FIG. 4, the wrapping paper may be supplied through a first bobbin 410 around which the wrapping paper is wound, and simultaneously, the tobacco extract sheet 10 may be supplied through a second bobbin 420 around which the tobacco extract sheet 10 is wound. Also, the supplied wrapping paper and tobacco extract sheet 10 may be laminated with each other through a press roller 440. Here, in a case in which the tobacco extract sheet 10 is made of a cellulose-based material which is a type of hydrocolloid material, a predetermined liquid may be sprayed through a sprayer 430. Also, the tobacco extract sheet 10 becomes sticky due to the sprayed liquid, and thus the tobacco extract sheet 10 can be strongly laminated with the wrapping paper without a separate adhesive. Also, accordingly, a wrapping material 450 of the smoking article can be easily produced. The produced wrapping material 450 may be cut into pieces of appropriate sizes and used as wrappers of smoking articles.

For example, the predetermined liquid may be water, ethanol, or the like but is not limited thereto.

In the present embodiment, a thickness of the tobacco extract sheet 10 supplied through the second bobbin 420 may be in a range of about 60 m to 150 m, and preferably in a range of about 60 m to 120 m. Within such numerical ranges, the tobacco extract sheet 10 can be easily laminated with the wrapping paper, the wrapping material 450 can be prevented from becoming too thick, and appropriate flexibility can be secured.

In some other embodiments, a wrapping material may be produced through a process of applying a sheet-producing liquid in a liquid phase onto the wrapping paper and drying the applied sheet-producing liquid. In order to further provide convenience of understanding, additional description of the present embodiment will be given with reference to FIG. 5.

Figure 5:
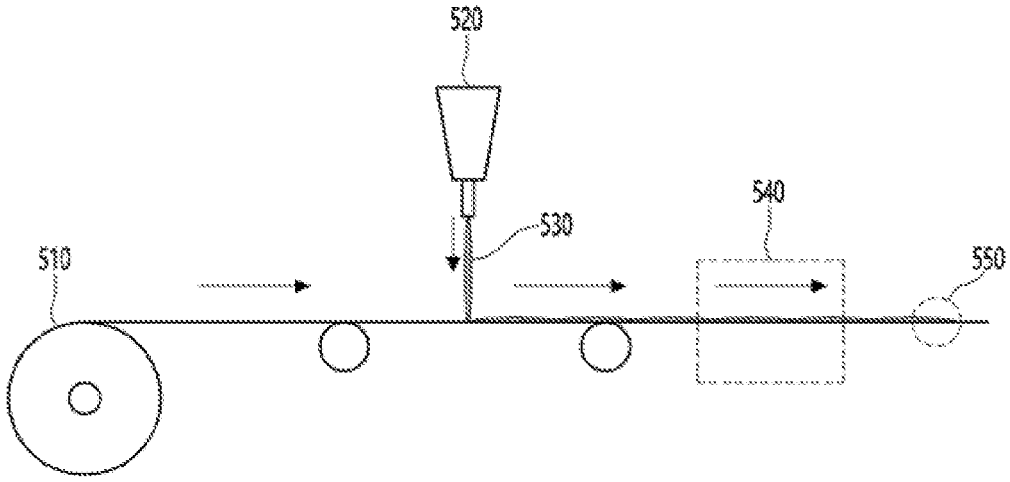
FIG. 5 is an exemplary view for describing a method of producing a wrapping material according to some other embodiments of the present disclosure.

As illustrated in FIG. 5, the wrapping paper may be supplied through a bobbin 510 around which the wrapping paper is wound. Also, through an applicator 520 (e.g., a nozzle), a sheet-producing liquid 530 in a liquid phase (e.g., a slurry form) may be applied on the supplied wrapping paper. The sheet-producing liquid 530 may be naturally dried during a wrapping paper conveying process (540) or may be dried in a separate drying facility. As a result, the sheet-producing liquid 530 can be appropriately coated on the wrapping paper, and a wrapping material 550 can be produced. The produced wrapping material 550 may be cut into pieces of appropriate sizes and used as wrappers of smoking articles.

Here, a thickness occupied by the coated sheet-producing liquid 530 may be less than or equal to about 100 μm, and preferably less than or equal to about 90 μm, 80 μm, 70 μm, 60 μm, or 50 μm. Within such numerical ranges, the wrapping material 550 can be prevented from becoming too thick, and appropriate flexibility can be secured.

The smoking article 100 and the methods of applying the tobacco extract sheet 10 thereto according to some embodiments of the present disclosure have been described above with reference to FIGS. 2 to 5. According to the above description, the tobacco extract sheet 10 can be applied to the smoking article 100 using various methods, and thus persistence of a tobacco smoke taste of the smoking article 100 can be improved.

Hereinafter, smoking articles 200 and 300 with improved flavor persistence according to some other embodiments of the present disclosure will be described with reference to FIGS. 6 and 7. However, for clarity of the present disclosure, description of contents overlapping with those described above in relation to the smoking article 100 will be omitted.

FIG. 6 is an exemplary view illustrating the smoking article 200 with improved persistence of a tobacco smoke taste according to some other embodiments of the present disclosure.

As illustrated in FIG. 6, the smoking article 200 may include a smoking material portion 210 and a filter portion 220, and the filter portion 220 may include a plurality of segments 221 and 222.

The smoking material portion 210 may correspond to the smoking material portion 110 described above. Therefore, description thereof will be omitted.

Next, the filter portion 220 may be made of a first segment 221 and a second segment 222. Of course, the filter portion 220 may further include a third segment (not illustrated).

The first segment 221 may perform a function of cooling smoke and/or an aerosol generated from the smoking material portion 210. Therefore, the first segment 221 may be referred to as "cooling segment 221" in some cases.

The first segment 221 may be produced in various forms. As an example, the first segment 221 may be a cylindrical paper tube that is made of a paper material and includes a hollow formed therein. As another example, the first segment 221 may be produced using a polymer material or a biodegradable polymer material. For example, the first segment 221 may be produced using a polylactic acid (PLA) fiber but is not limited thereto. As still another example, the first segment 221 may be produced as a cellulose acetate filter having a plurality of holes formed therein. As yet another example, the first segment 221 may be a tubular filter including a hollow formed therein. For example, the first segment 221 may be a cellulose acetate filter including a hollow formed therein. However, the first segment 221 is not limited thereto and may be produced in any other form as long as the first segment 221 can perform a cooling function.

In some embodiments, the tobacco extract sheet 10 may be applied to the first segment 221. For example, the tobacco extract sheet 10 may be disposed in a form of being rolled on the hollow of the first segment 221 or may be attached onto an inner wall of the hollow. As still another example, the tobacco extract sheet 10 which is processed so that a plurality of holes are formed therein may be disposed in a form being rolled on the hollow. In this case, an airflow path can be easily secured through the plurality of holes, and a cooling effect can also be improved due to an increase in an area of contact between the tobacco extract sheet 10 and the airflow.

Next, the second segment 222 may perform a function of filtering smoke and/or an aerosol that passed through the first segment 221. Therefore, the second segment 222 may be referred to as "filter segment 222" in some cases. Alternatively, due to being located at a mouthpiece portion, the second segment 222 may be referred to as "mouthpiece segment 222."

In some embodiments, the second segment 222 may include at least one capsule 240. Here, the capsule 240 may perform a function of producing a flavor or perform a function of generating an aerosol. For example, the capsule 240 may have a structure in which a liquid including a flavoring is wrapped by a film. Also, the capsule 240 may have a spherical or cylindrical shape, but the shape of the capsule 240 is not limited thereto.

Next, a wrapper 230 may correspond to the wrapper 130 described above. Therefore, description thereof will be omitted. As mentioned above, the tobacco extract sheet 10 may be applied to the wrapper 230. In that way, persistence of a tobacco smoke taste of the smoking article 200 can be significantly improved.

Meanwhile, although not illustrated in FIG. 6, the smoking article 200 may further include a plug (not illustrated) disposed at an end. For example, the plug may be disposed at an upstream end of the smoking article 200 and perform a function of appropriately controlling the overall length of the smoking article 200. Also, in a case in which the smoking article 200 is inserted into an aerosol generation device (not illustrated), the plug may perform a function of controlling the smoking material portion 210 to be disposed at an appropriate position inside the aerosol generation device.

FIG. 7 is an exemplary view schematically illustrating the smoking article 300 according to still some other embodiments of the present disclosure.

As illustrated in FIG. 7, the smoking article 300 may include a smoking material portion 310 and a filter portion 320, the smoking material portion 310 may include a plurality of segments 311 and 312, and the filter portion 320 may include a plurality of segments 321 and 322.

As illustrated, the smoking material portion 310 may be made of a first segment 311 and a second segment 312. Of course, the smoking material portion 310 may further include a third segment (not illustrated).

The first segment 311 may include a moisturizer. For example, the first segment 311 may include crimped paper impregnated with a moisturizer. For example, the moisturizer may include at least one of glycerin, propylene glycol, ethylene glycol, dipropylene glycol, diethylene glycol, triethylene glycol, tetraethylene glycol, and oleyl alcohol.

Next, the second segment 312 may include a nicotine-generating substrate such as a tobacco material. For example, the nicotine-generating substrate may include shredded tobacco, tobacco particles, tobacco sheets, tobacco beads, and tobacco granules. As another example, the nicotine-generating substrate may include crimped paper impregnated with tobacco extracts. When the nicotine-generating substrate is heated, nicotine may be generated from the nicotine-generating substrate and transferred to the filter portion 320.

Next, the filter portion 320 may include the plurality of segments 321 and 322. For example, the filter portion 320 may include a third segment 321 configured to perform a cooling function and a fourth segment 322 configured to perform a filtering function. The contents described above in relation to the filter portion 220 of FIG. 6 may identically apply to the filter portion 320, and thus further description thereof will be omitted.

Next, a wrapper 330 may correspond to the wrapper 130 described above. Therefore, description thereof will be omitted. As mentioned above, the tobacco extract sheet 10 may be applied to the wrapper 330. In that way, persistence of a tobacco smoke taste of the smoking article 300 can be significantly improved.

The smoking articles 200 and 300 according to some other embodiments of the present disclosure have been described above with reference to FIGS. 6 and 7.

Hereinafter, the configurations and effects of the tobacco extract sheet 10 will be further clarified using examples and an experimental example. However, the following examples are only some examples of the tobacco extract sheet 10, and thus the scope of the present disclosure is not limited by the following examples.

Examples 1 to 7

Tobacco extract sheets having weight ratios shown in Table 1 below were produced, and the produced tobacco extract sheets were added to smoking material portions to manufacture heating-type cigarettes.

TABLE 1

| Component | Example 1 | Example 2 | Example 3 | Example 4 | Example 5 | Example 6 | Example 7 |
|---|---|---|---|---|---|---|---|
| HPMC | 18 | — | — | — | — | — | — |
| MC | — | 18 | — | 18 | 18 | 18 | 18 |
| Agar | — | — | 18 | — | — | — | — |
| Dextrin | 3 | 3 | 3 | 3 | 3 | 3 | 3 |
| β-cyclodextrin | 9 | 9 | 9 | 9 | 9 | 9 | 9 |
| Water + tobacco extract | 150 | 150 | 150 | 170 | 100 | 150 | 150 |
| Ethyl alcohol + tobacco extract | 20 | 20 | 20 | 0 | 70 | 20 | 20 |
| PG + tobacco extract | 3 | 3 | 3 | 3 | 3 | — | 3 |
| GLY + tobacco extract | 3 | 3 | 3 | 3 | 3 | 3 | — |
| Total | 206 | 206 | 206 | 206 | 206 | 203 | 203 |

Experimental Example 1: Evaluation of Level of Difficulty of Preparation, Physical Properties, and Sensory Characteristics An experiment to comprehensively evaluate a level of difficulty of preparing a sheet-producing liquid, physical properties of the sheet, and sensory characteristics such as an off-taste, a tobacco smoke taste intensity, and a tobacco smoke flavor was conducted on tobacco extract sheets and cigarettes according to Examples 1 to 7. The evaluation of the sensory characteristics was performed by a panel of smokers with a smoking experience of five years or more, the evaluation was performed based on high/medium/low grade, and results of the evaluation are shown in Table 2 below.

TABLE 2

| Evaluation item | Example 1 | Example 2 | Example 3 | Example 4 | Example 5 | Example 6 | Example 7 |
|---|---|---|---|---|---|---|---|
| Level of difficulty of preparing a sheet-producing liquid | High | Low | High | High | Low | Low | Low |
| Physical properties of dried sheet | High | High | High | Low | Medium | High | High |
| Off-taste during smoking | Medium-high | Low | Medium | Low | Low | Low | Low |
| Tobacco smoke taste intensity | Medium-high | Medium-high | Medium-high | High | Medium | Medium | Medium |
| Tobacco smoke flavor | High | High | High | Medium-high | Medium | High | High |

Referring to Table 2 above, the level of difficulty of preparing a sheet-producing liquid was found to be decreased when MC and ethyl alcohol were mixed (refer to Example 2 and Examples 5 to 7).

Also, the tobacco extract sheet according to Example 4 that was produced without ethyl alcohol was brittle when dried, and the physical properties of the sheet were evaluated as being relatively inferior. Also, due to a high viscosity of the sheet-producing liquid, the level of difficulty of preparing the sheet-producing liquid was evaluated as being considerably high.

Also, the tobacco extract sheet (or cigarette) according to Example 1 or Example 3 was evaluated as causing a strong off-taste during smoking as compared to other examples. In other words, the tobacco extract sheet using HPMC or agar was evaluated as causing a stronger off-taste than the tobacco extract sheets using MC.

Also, addition of a plasticizer (e.g., PG, GLY) was evaluated as having a positive influence on physical properties (e.g., flexibility, brittleness) of the sheet but not having much influence on sensory characteristics such as a tobacco smoke flavor and a tobacco smoke taste intensity. Therefore, it can be seen that it is preferable to add a plasticizer in an appropriate proportion when preparing the sheet-producing liquid.

The configurations and effects of the tobacco extract sheet 10 have been described in more detail above using the examples and the experimental example.

The embodiments of the present disclosure have been described above with reference to the accompanying drawings, but those of ordinary skill in the art to which the present disclosure pertains should understand that the present disclosure may be embodied in other specific forms without changing the technical spirit or essential features thereof. Therefore, the embodiments described above should be understood as being illustrative, instead of limiting, in all aspects. The scope of the present disclosure should be interpreted according to the claims below, and any technical spirit within the scope equivalent to the claims should be interpreted as falling within the scope of the technical spirit defined by the present disclosure.

The invention claimed is:

1. A tobacco extract sheet that is produced from a sheet-producing liquid which includes a first tobacco extract solution, a second tobacco extract solution, and a sheet-forming agent, wherein the first tobacco extract solution includes water as an extraction solvent, and the second tobacco extract solution includes a material other than water as the extraction solvent, wherein the extraction solvent of the second tobacco extract solution is a plasticizer.

2. The tobacco extract sheet of claim 1, wherein the sheet-forming agent is a cellulose-based material.

3. The tobacco extract sheet of claim 1, wherein the sheet-producing liquid includes, with respect to a total of 100 parts by weight:

5 to 25 parts by weight of the sheet-forming agent;

50 to 80 parts by weight of the first tobacco extract solution; and 5 to 10 parts by weight of the second tobacco extract solution.

4. The tobacco extract sheet of claim 1, wherein:

the sheet-producing liquid further includes a third tobacco extract solution; and the third tobacco extract solution includes ethyl alcohol as the extraction solvent.

5. The tobacco extract sheet of claim 4, wherein the sheet-producing liquid includes, with respect to a total of 100 parts by weight:

5 to 20 parts by weight of the sheet-forming agent;

40 to 80 parts by weight of the first tobacco extract solution;

5 to 10 parts by weight of the second tobacco extract solution; and 10 to 50 parts by weight of the third tobacco extract solution.

6. The tobacco extract sheet of claim 4, wherein the sheet-producing liquid further includes a bulking agent.

7. The tobacco extract sheet of claim 6, wherein the sheet-producing liquid includes, with respect to a total of 100 parts by weight:

5 to 15 parts by weight of the sheet-forming agent;

40 to 80 parts by weight of the first tobacco extract solution;

5 to 10 parts by weight of the second tobacco extract solution;

10 to 50 parts by weight of the third tobacco extract solution; and 1 to 10 parts by weight of the bulking agent.

8. A smoking article comprising:

a smoking material portion;

a filter portion; and a wrapper wrapped around at least a portion of the smoking material portion, wherein the tobacco extract sheet according to claim 1 is applied to at least one of the smoking material portion, the filter portion, and the wrapper.

* * * * *